US006267548B1

(12) United States Patent
Lech et al.

(10) Patent No.: US 6,267,548 B1
(45) Date of Patent: Jul. 31, 2001

(54) AUTOMATIC OVER CENTER SYSTEM

(75) Inventors: Richard J. Lech, Burlington; Roger D. Mickelson, West Burlington; Robert E. Wawiorka, Burlington, all of IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/208,896

(22) Filed: Dec. 10, 1998

(51) Int. Cl.[7] ..... E02F 9/00
(52) U.S. Cl. ..... 414/699; 414/694; 91/437
(58) Field of Search ..... 414/694, 680, 414/685, 698, 699; 91/436, 437

(56) References Cited

U.S. PATENT DOCUMENTS 5,007,544 * 4/1991 Saotome et al. ..... 91/437 X

* cited by examiner

*Primary Examiner*—Donald W. Underwood
(74) *Attorney, Agent, or Firm*—Mayer, Brown & Platt

(57) ABSTRACT

The present invention is directed to a control circuit for automatically bringing a hydraulically operated work arm into a particular position without having to manually reverse the direction of the hydraulic operating system.

4 Claims, 4 Drawing Sheets

AUTOMATIC OVER CENTER SYSTEM

BACKGROUND OF THE INVENTION

1. Field of the Invention

The present invention relates to a control circuit for assisting operator effected storage of a hydraulically operated articulated work arm into an "over center" storage position. By permitting simplified operation of the work arm into the storage position, the functionality of the apparatus is increased. The control circuit includes an electrically operated valve, which may be a solenoid valve, that is operably connected to the hydraulic operating system of the work arm. Further, the control circuit includes a controller for the solenoid so that operation of the work arm into various selected positions is simplified.

2. Description of Related Art

Mobile construction equipment such as tractors outfitted with a hydraulically operated articulated work arm carrying any one of a variety of attachments are used for a wide variety of applications. In particular, they are critical machines in the construction of buildings, transportation channels, and almost any other man-made structure. A practical matter involves the transport of such equipment, such as, for example, a backhoe between the physical locations where it will be used. If the equipment is driven to the desired location over roadways, difficulties associated with the weight distribution of the equipment often arise. In particular, the overhanging, leveraged weight of the backhoe linkage assembly increases the difficulty of controlling the equipment during transportation. The effective weight of the backhoe linkage assembly can affect equipment weight balance sufficiently such that the weight remaining on the front wheels is lessened and steering control and ride comfort may be compromised.

To date, the most common approach to dealing with the undesirable weight distribution of this type of construction equipment is to add weight to the front of the machine to counter the weight of the backhoe linkage assembly. However, this solution is undesirable for several reasons. The additional weight causes the equipment to become more difficult to maneuver, especially in soft ground, more difficult to steer, and more clumsy to operate. In addition, fuel consumption is increased and the equipment cost effectiveness is decreased.

A more desirable solution to the problem of weight distribution has been to move the backhoe linkage assembly into a stored position where its weight is closer to the center of the equipment. For example, Case Corporation of Racine, Wisconsin builds backhoe-type machines with a distinctive feature, known as an "over center" system, that permits the weight of the backhoe to be moved closer to the center of the equipment, whereby the weight moment arm is reduced. By shifting the weight of the backhoe toward the equipment's center of gravity, the need for a front-end counter weight is eliminated. The "over center" position of the backhoe linkage assembly is frequently known as the "carry," the "latched," or the "transport" position. The "over center" system, as noted above, increases the maneuverability of the equipment, particularly in soft ground, and increases the stability of the equipment during road transportation.

While the "over center" system provides significant benefits, use of the system requires operator skills that are acquired only through experience. Thus, while not always difficult for regular users of the equipment, the technique may often be awkward for new or occasional users of the machine. The technique involves a combination of operator actions that must be completed in timed sequence. The technique of moving the backhoe into the "over center" position requires the operator to activate the lift cylinder and raise the work arm toward its uppermost position. At the moment that the lift cylinder is at its minimum length, the operator must then rapidly change the direction of the hydraulic control spool to reverse the direction of the lift cylinder operation to thereby drive the backhoe into the "over center" transport position. If the control spool is not operated at the right moment, the backhoe assembly will stop moving and will not reach the transport position. The entire process must then be repeated. First time operators and operators without significant experience often have difficulty performing the technique.

The present invention for the first time provides an apparatus for reducing the heretofore important nature of operator performance in placing equipment work arms into the over-center storage/transport position. Thus, new and less experienced operators can prepare the backhoe for travel between work sites.

SUMMARY OF THE INVENTION

The purpose and advantages of the invention are set forth in and will be apparent from the description and drawings that follow. Additional advantages of the invention will be realized and attained by the elements of the device particularly pointed out in the appended claims.

The present invention is directed to a control circuit for use in combination with an apparatus having a hydraulically operated articulated work arm that is movable over a range of positions. More particularly, the present invention involves a control circuit for use in combination with an apparatus having a hydraulically operated work arm, such as a backhoe machine, for which there are desired arm positions, such as an "over center" transport position.

The present invention can be applied to any hydraulically operated articulated work arm in which it is necessary to reverse the flow of fluid through the hydraulic cylinder in order to achieve a desired position of the work arm. The control circuit that is used in combination with the apparatus comprises a valve, preferably a solenoid valve, a source of electricity for operating the solenoid valve, and a switching mechanism. The solenoid valve is operably connected with the work arm hydraulic operating system.

The switching mechanism is electrically connected in series between the electrical source and the solenoid valve in order to control operation of the solenoid valve. In operation, the solenoid valve is either in a closed or open position and therefore either prevents or permits the flow of hydraulic fluid into the head side of the cylinder. If the solenoid valve is configured to be in a "closed" position when there is no electrical flow, when the switching mechanism is activated to permit the flow of electricity to the solenoid valve, the solenoid valve will change to an "open" position so that hydraulic fluid can flow to the head side of the cylinder. In one embodiment of the present invention, the work arm hydraulic operating system comprises one or more supply lines leading to the work arm. The solenoid valve is then positioned between the supply lines to control the flow of hydraulic fluid.

The switching mechanism of the invention includes a first manually actuated operator switch and a second position actuated switch connected serially with the first switch. The position actuated switch is located remotely from the manually actuated operator switch. The position actuated switch is in an operative position associated with the work arm and responsive to the position of the work arm so that electricity will flow to the solenoid valve when the first manually actuated operator switch is closed and the work arm is located at a preselected position. In one embodiment of the invention, the second position actuated switch is located on the work arm. While the position actuated switch can be set to respond to any preselected position of the work arm, in a preferred embodiment of the invention, the position actuated switch is indexed to a vertical position of the work arm. In applications where the position actuated switch is indexed to the work arm's vertical position, the work arm can be pulled into the "over center" or transport position.

It is to be understood that both the foregoing general description and the following detailed description are exemplary and provided for purposes of explanation only, and are not restrictive of the invention, as claimed.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

DETAILED DESCRIPTION OF THE PREFERRED EMBODIMENT

Figure 1:
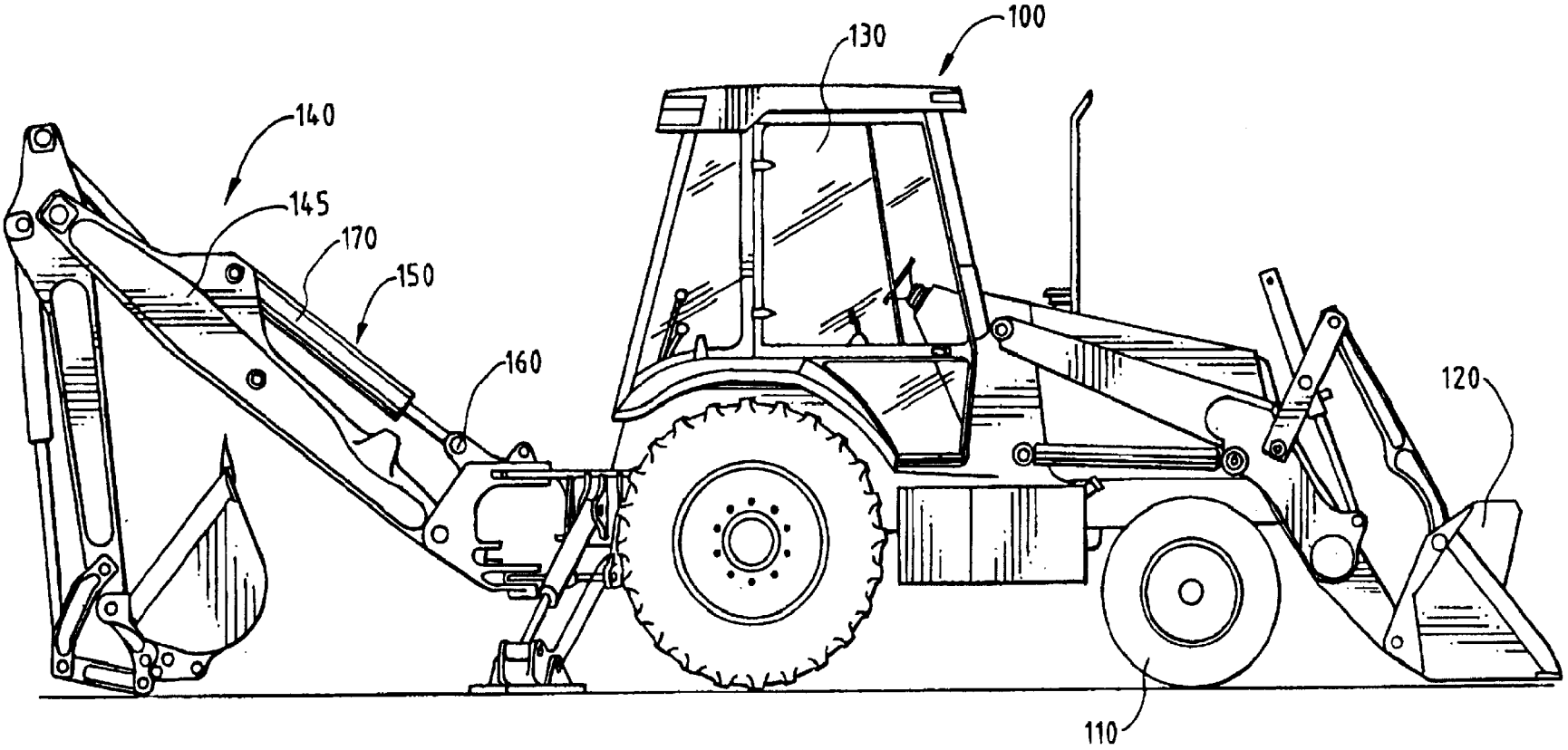
FIG. 1 is a side elevation of a backhoe machine that is in an operating position.

Reference will now be made in detail to the present preferred embodiment of the control circuit of the invention, examples of which are illustrated in the accompanying drawings. Wherever possible, the same reference characters will be used throughout the drawings to refer to the same or like parts.

The present invention is directed to a combination of an apparatus having a hydraulically operated work arm and a control circuit. The work arm of the apparatus has a range of motion in which it can be operated to be positioned at various desired locations. In a preferred embodiment of the invention, the apparatus is a backhoe-type machine where it is advantageous to place the work arm into an "over center" position for transportation.

The present invention is applicable to any apparatus having a hydraulically operated work arm. The present invention is particularly applicable to providing an improved method for achieving a preselected location of the work arm. FIG. 1 is a side elevation of one type of apparatus having a hydraulically operated work arm, namely a backhoe/loader machine 100. A backhoe/loader machine 100 includes an operator's compartment 130, a loader 120, and a backhoe 140. In a typical backhoe/loader machine 100, the weight is unevenly distributed. The backhoe 140 portion of the machine 100 is disproportionately heavy and causes shifts in the center of gravity rearwardly away from the operator's compartment 130 when extended. The off-center weight distribution of the machine 100 makes ground transportation of the machine 100 more difficult. For example, steering control is diminished and the ride is uncomfortable at typical road speeds.

Figure 3:
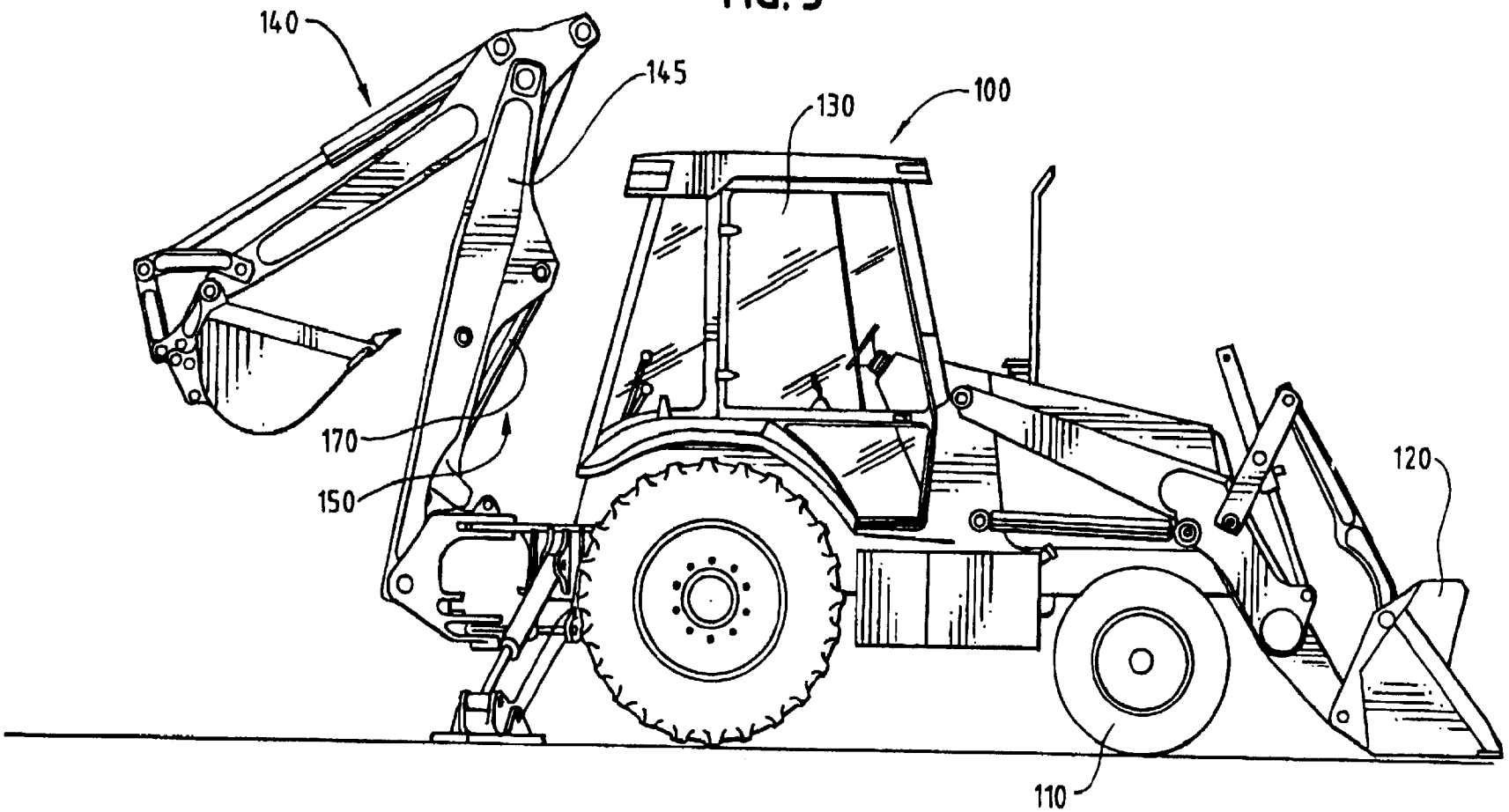
FIG. 3 is a side elevation of a backhoe machine that is in an "over center" or transport position.

For transportation purposes, the weight distribution of the machine 100 is improved by moving the backhoe 140 weight closer to the center of the machine 100. By moving the backhoe 140 closer to the operator's compartment 130, the center of gravity for the machine 100 is shifted forwardly and it is not necessary to add weight to the front wheels 110 to counter balance the weight of the backhoe attachment. As a result, the machine 100 becomes more maneuverable, more stable on the road, and better able to negotiate difficult terrain. The different locations of the backhoe 140 in relation to the operator's compartment 130 between the operating and transport positions are depicted in FIGS. 1 and 3, respectively.

Figure 2:
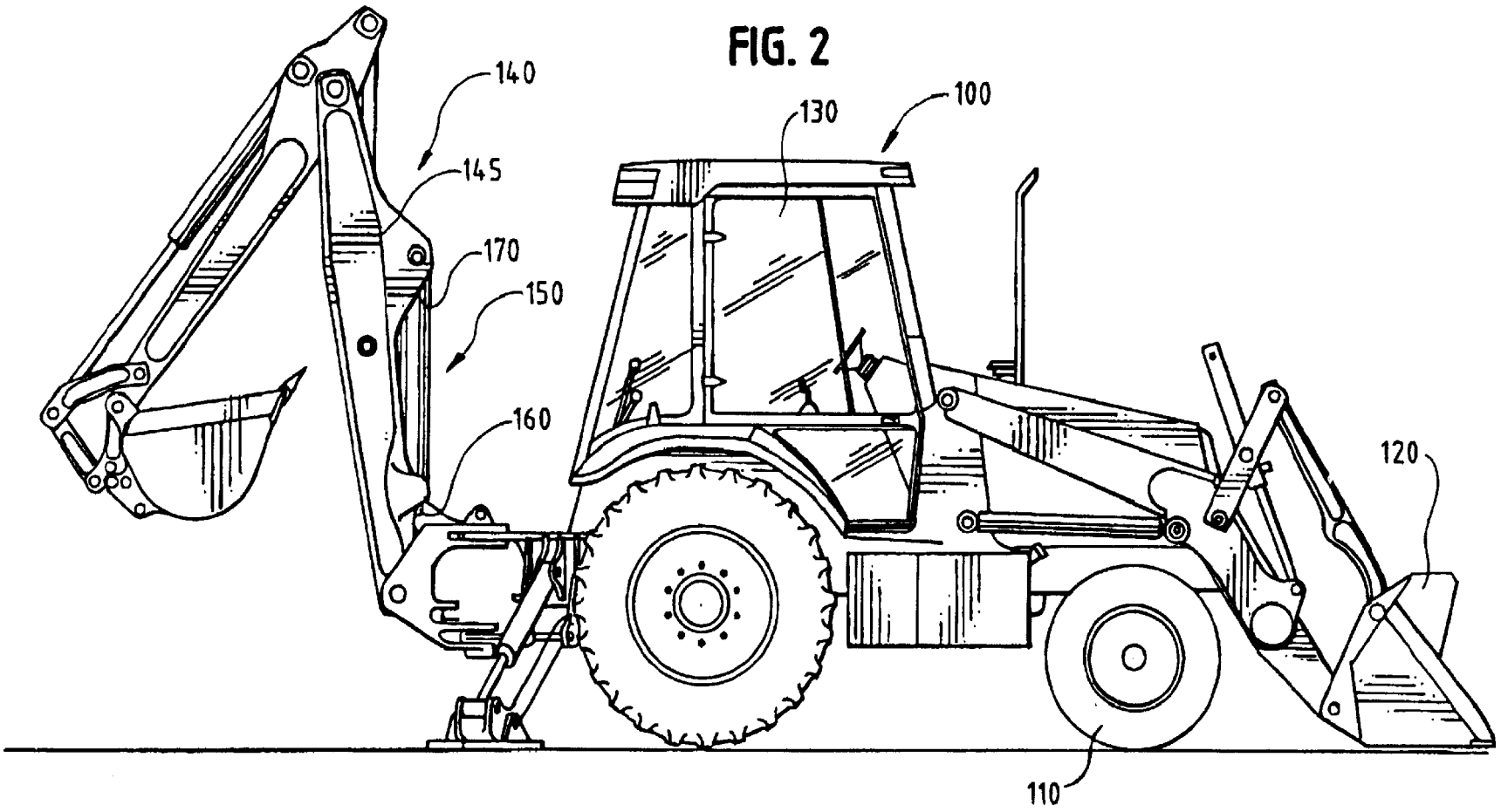
FIG. 2 is a side elevation of a backhoe machine that is in transition between and operating position and a transport or carry position.

The transport position of the backhoe 140 can be described as an "over center" position because the cylinder 150 is moved beyond its shortest length and the backhoe 140 is brought toward the operator's compartment 130. A hydraulically operated lift cylinder 150 is typically used to lift the work arm 145 of the backhoe 140 upwardly from its operating position by rotating about a pivot point 160. As the work arm 145 is lifted toward its vertical position, the lift cylinder 150 shortens. The direction of flow of hydraulic fluid is such that the piston of the lift cylinder 150 moves into the cylinder portion, toward the head side 170 of the cylinder. As the work arm 145 of the backhoe 140 moves toward a vertical position, as depicted in FIG. 2, the lift cylinder 150 approaches its shortest length. In order to bring the work arm 145 into an "over center" position, the flow of hydraulic fluid within the lift cylinder 150 must be reversed so that the length of the lift cylinder 150 can increase as the work arm 145 is pulled past the vertical position and toward the operator's compartment 130.

Presently, in order to bring the work arm 145 into the over center position, the operator of the machine 100 must operate the lift cylinder 150 in such a way that the flow direction of hydraulic fluid is reversed at precisely the right time. This method can be difficult for new or infrequent operators of the machine 100. First the operator must initiate the lift cylinder's 150 lifting of the work arm 145 upwardly toward a vertical position. As the work arm 145 approaches a vertical position and when the lift cylinder 150 has its shortest length, the operator must quickly reverse the direction of hydraulic fluid flow in the lift cylinder 150 in order to force the lift cylinder 150 to begin to lengthen again and to move the work arm 145 into the over center position. If the operator's timing is off, the lift cylinder 150 will stop and not move the work arm 145 into the "over center" position. The procedure must then be repeated.

Figure 4:
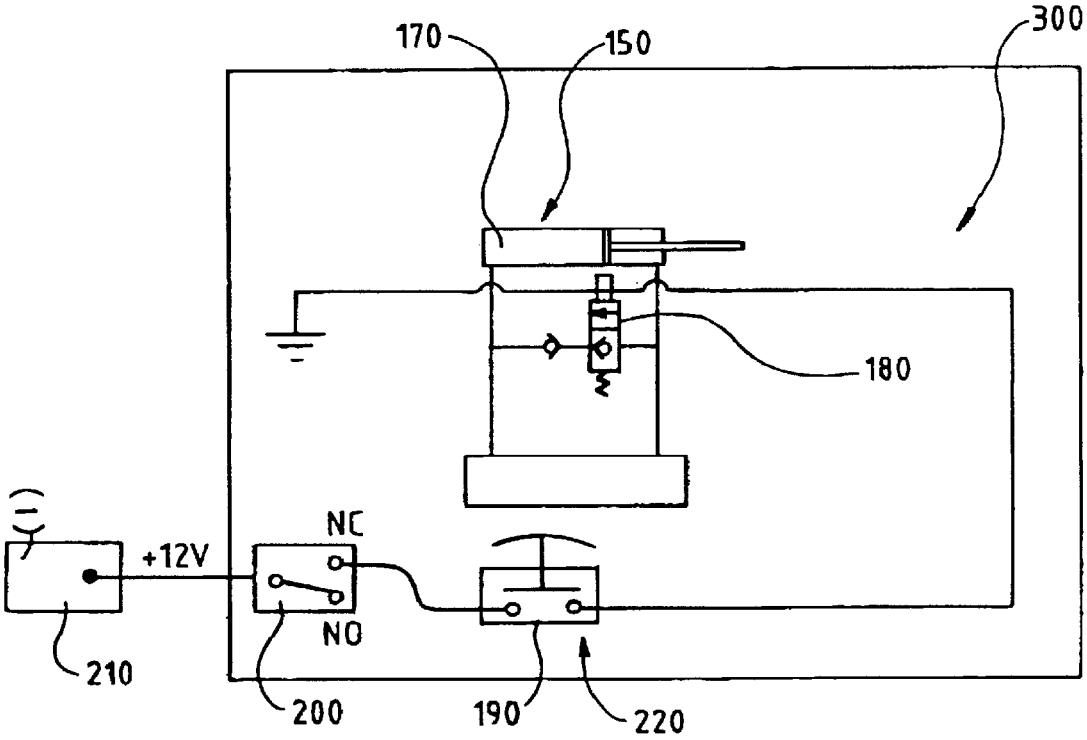
FIG. 4 is a schematic drawing of the control circuit of the invention that can be used in combination with a backhoe-type machine.

In order to overcome the deficiencies of the existing method, the present invention applies a control circuit to automatically sense when the work arm 145 is in its vertical position, or in any other preselected position, to automatically reverse the direction of the lift cylinder 150. A schematic representation of a preferred embodiment of the control circuit of the invention is depicted in FIG. 4.

The control circuit 300 includes a solenoid valve 180 that is operably connected with the hydraulic operating system of the work arm 145 and a source of electricity 210 for operating the solenoid valve 180. The control circuit 300 further includes a switching mechanism 220 that is electrically connected in series between the electrical source 210 and the solenoid valve 180 in order to control the operation of the solenoid valve 180. The switching mechanism 220 includes a first manually actuated operator switch 190 and a second position actuated switch 200. The second position actuated switch 200 is connected serially with the first manually actuated operator switch 190. The position actuated switch 200 is physically located away from the manually actuated operator switch 190 and is in an operative position associated with the work arm 145 and responsive to the position of the work arm 145. The position actuated switch 200 is then able to connect the electrical source 210 to the solenoid valve 180 when the operator switch 190 is closed and the work arm 145 is located at a preselected location, such as vertical.

In a preferred embodiment, the solenoid valve 180 is positioned between the hydraulic fluid supply lines that lead to the lift cylinder 150. The operator switch 190, which is in series with the solenoid valve 180, is located conveniently to the operator, such as being located in the operator's compartment 130. The operator switch 190 can be in the form of an actuator button or a similar device. The position actuated switch 200 is located so as to be associated with the work arm 145. In one embodiment, the position actuated switch 200 is located at the base of the lift cylinder 150 and is indexed to detect a vertical position of the work arm 145. In order to move the backhoe 140 from an operating position to an "over center" position, the operator activates the hydraulic operating system such that the lift cylinder 150 begins to shorten and to upwardly move the work arm 145. At the same time that the lift cylinder 150 is activated, the operator depresses the actuator button, or other device, of the operator switch 190. When the work arm 145 reaches a vertical position, the position actuated switch 190 completes the control circuit 300. Once the control circuit 300 is complete, the electrical source 210 becomes connected to the solenoid valve 180 and, therefore, opens the solenoid valve 180. When the solenoid valve 180 is open, both ends of the lift cylinder 150 are open to the hydraulic fluid supply source. This permits pump flow and cylinder discharge flow to enter the head side 170 of the lift cylinder 150 and to push the piston away from the head side 170 of the lift cylinder 150, thereby again increasing the length of the lift cylinder 150. The inertia of the moving backhoe 140 and the pressure on the head side 170 carry the work arm 145 into the "over center" or transport position. Rather than having to reverse the direction of the lift cylinder 150 when the work arm 145 is precisely at the vertical position, the operator simply activates the lift cylinder 150 while simultaneously actuating the operator switch 190.

FIGS. 1–3 depict the sequence of events between moving the backhoe 140 from an operating position depicted in FIG. 1 to a transport or latched position in FIG. 3. In FIG. 1, the backhoe 140 is in the position in which it would be used by the operator for its intended function. The lift cylinder 150 is fully extended and the solenoid valve 180 of the control circuit 300 is closed. When the job is completed or when it is necessary to transport the machine 100, the operator will want to move the backhoe 140 into the transport or carry position. The operator begins the process of moving the backhoe 140 by activating the lift cylinder 150 to move the backhoe 140 upward. As the lift cylinder 150 moves the work arm 145 of the backhoe 140 upward, the length of the lift cylinder 150 decreases as it rotates upwardly about the pivot point 160. At the same time that the operator activates the lift cylinder 150, the actuator button is manually operated to enable the system.

FIG. 2 represents the position of the backhoe 140 when the work arm 145 is at or near vertical position. The lift cylinder 150 is at its shortest length and, therefore, the piston is completely inside the cylinder. If the backhoe 140 were left in this position for transportation, the machine's 100 center of gravity would be weighted toward the backhoe 140. In order to move the center of gravity toward the center of the machine 100, the front wheels 110 would have to be weighted. This is undesirable as it has negative consequences on the transportability of the machine 100 as described herein. At the point that the work arm 145 reaches the vertical position depicted in FIG. 2, the position actuated switch 200, which has been indexed to the vertical position of the work arm 145, is activated. The position actuated switch 200 can be indexed to any desired position of the work arm 145; for the present application, indexing to the vertical position is desirable. Activation of the position actuated switch 200 results in the control circuit 300 being completed so that electricity can flow from the electrical source 210 to the solenoid valve 180. As a result, the solenoid valve 180 opens which permits pump flow and cylinder discharge flow of the hydraulic fluid to enter the head side 170 of the lift cylinder 150.

With the solenoid valve 180 open, the lift cylinder 150 begins to extend its length again, and the work arm 145 pivots past a vertical position toward the operator's compartment 130. The inertia of the work arm 145 and the pressure on the head side 170 of the lift cylinder 150 carry the backhoe 140 into the transport or latched position. The transport position of the backhoe 140 is depicted in FIG. 3. The transport position is characterized by the work arm 145 being "past" or "over" the vertical or center position. In this "over center" position, the machine's 100 center of gravity is closer to the operator's compartment 130. By moving the center of gravity closer to the operator's compartment 130, the need for adding weight to the front wheels 110 is eliminated. In the "over center" position, the machine 100 is more maneuverable and better able to negotiate difficult terrains at road speeds.

If the operator switch 190 is not activated, the backhoe 140 has to be put into the "over center" position by the method currently used in which the operator must decide when to reverse the direction of the lift cylinder 150. If the position actuated switch 200 or the operator switch 190 are activated independently, there is no effect on the operation of the backhoe 140.

Although reference has been made to the use of the present invention in conjunction with bringing the backhoe portion of a backhoe/loader machine into an "over center" position for the purpose of explanation, it is understood that alternative uses for the control circuit of the invention exist. It also will be apparent to those skilled in the art that various modifications and variations can be made in the design and construction of the control circuit without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. In combination with an apparatus having an articulated work arm that is movable to a transport position and a hydraulic operating system therefore, a control circuit comprising:

a solenoid valve operably connected with the work arm hydraulic operating system;

a source of electricity for operating the solenoid; and a switching mechanism electrically connected in series between the electrical source and the solenoid to control operation thereof, said switching mechanism including a manually actuated operator switch and a position actuated switch located remotely from the operator switch in an operative position associated with the work arm and responsive to the position of the work arm so as to connect the electrical source to the solenoid valve when the operator switch is closed and the work arm is at a preselected position.

2. The control circuit of claim 1 wherein the work arm hydraulic operating system comprises supply lines leading to the work arm and the solenoid valve is positioned between the supply lines.

3. The control circuit of claim 1 wherein the position actuated switch is located on the work arm.

4. The control circuit of claim 1 wherein the preselected location of the work arm is the vertical position.

* * * * *